US007101279B2

(12) United States Patent
O'Hagin et al.

(10) Patent No.: US 7,101,279 B2
(45) Date of Patent: Sep. 5, 2006

(54) SOLAR-POWERED ATTIC VENT WITH A ONE-PIECE, FITTED SKELETON

(76) Inventors: Harry T. O'Hagin, 119/15 Moo 3 Bann KHO, Panakorn Sri, Ayutthaya (TH) 13000; Carolina O'Hagin, 1349 Cunningham Rd., Sebastopol, CA (US) 95472

( * ) Notice: Subject to any disclaimer, the term of this patent is extended or adjusted under 35 U.S.C. 154(b) by 67 days.

(21) Appl. No.: 10/834,572

(22) Filed: Apr. 27, 2004

(65) Prior Publication Data

US 2005/0239394 A1 Oct. 27, 2005

(51) Int. Cl.
*F24F 7/02* (2006.01)

(52) U.S. Cl. ..... 454/364; 52/198

(58) Field of Classification Search ..... 454/364, 454/365, 366; 52/198, 199
See application file for complete search history.

(56) References Cited

U.S. PATENT DOCUMENTS 4,314,548 A * 2/1982 Hanson ..... 126/632
4,625,469 A * 12/1986 Gentry et al. ..... 52/3
4,759,272 A * 7/1988 Zaniewski ..... 454/344
4,843,794 A * 7/1989 Holtgreve ..... 52/199
4,850,166 A * 7/1989 Taylor ..... 52/199
4,965,971 A * 10/1990 Jean-Jacques et al. ..... 52/199
5,078,047 A 1/1992 Wimberly
5,316,592 A 5/1994 Dinwoodie
5,505,788 A 4/1996 Dinwoodie
5,746,839 A 5/1998 Dinwoodie
6,050,039 A * 4/2000 O'Hagin ..... 52/302.1
6,129,628 A 10/2000 O'Hagin et al.

FOREIGN PATENT DOCUMENTS

DE 198 23 356 A 1 11/1999

OTHER PUBLICATIONS

International Search Report and Written Opinion of the International Searching Authority for counterpart International Application No. PCT/US2005/012986, examining claims 1-10 as originally filed in present application.

* cited by examiner

*Primary Examiner*—Derek S. Boles
(74) *Attorney, Agent, or Firm*—Knobbe Martens Olson & Bear LLP

(57) ABSTRACT

The present invention provides a solar-powered ventilation system for an attic or rafter space that mimics the appearance of the roofing material and thus has little effect on the appearance of the building. The vent has two pieces, a primary vent and a secondary vent. The primary vent is installed on a roof deck over a ventilation opening cut through the deck. The secondary vent is constructed to look like the surrounding field tiles and is installed over the primary vent. The secondary vent includes a solar panel preferably attached to the top surface of the secondary vent. One or more vent openings in the secondary vent and an opening in the primary vent conduct air between the attic or rafter space and the outside. In certain preferred embodiments, a solar-powered fan is also preferably located underneath the secondary vent.

10 Claims, 7 Drawing Sheets

SOLAR-POWERED ATTIC VENT WITH A ONE-PIECE, FITTED SKELETON

BACKGROUND OF THE INVENTION

1. Field of the Invention

This invention relates to roof vents, and more specifically to attic vents for use on tile roofs.

2. Description of the Related Art

Energy efficiency is a serious consideration in new home design. New homes require ways to minimize energy requirements to maintain comfortable living spaces. One of the most common energy losses in a home is due to heat transfer through the attic. In warm climates, heat builds up in the attic from solar energy incident on the roof. In colder climates, moisture builds up in the attic, robbing the insulation of much of its R value. Early efforts at minimizing the effects of heat and/or moisture build-up focused on insulation between the living space and the attic. Gable vents and dormer type passive ventilation systems have been incorporated to ventilate the attic. U.S. Pat. No. 6,050,039 to O'Hagin describes one such camouflaged passive ventilation system. However, this passive ventilation system does not teach a camouflaged active ventilation system.

In other systems, active grid-powered ventilation systems using gable vents and powered dormer type vents have been used to increase the ventilation of the attic. These grid-powered active ventilation systems require increased operation and installation costs compared with passive systems. In the southwest, many homes have low pitch, hip roofs which have no gables, and dormers may destroy the aesthetics of a design if improperly located or too numerous. Therefore, these systems have proven to be inadequate.

What is needed is an improved ventilation system that will minimally detrimentally affect the appearance of a building design if used in adequate numbers to properly ventilate the attic, and is applicable to many roof configurations and with many types of roofing materials, while offering low operation and installation costs relative to other active ventilation systems.

SUMMARY OF THE INVENTION

Preferred embodiments of the present invention provide a solar-powered ventilation system for an attic or rafter space that protrudes minimally from the surface of the roof and a vent skeleton that mimics the appearance of roofing tiles, thus, having a minimal negative effect on the appearance of the building.

In accordance with a preferred embodiment, a roof vent is provided comprising a vent skeleton having skeleton vent openings there through. The vent openings are configured to ventilate through a roof opening a volume of air underneath a roof. In addition, the vent skeleton is configured to, when installed on a roof, substantially mimic surrounding roofing tiles. A solar array is integrated with the roof vent in a position capable of receiving sunlight when the roof vent is installed on a roof.

In accordance with another preferred embodiment, a roof system is provided for a sloped roof having a plurality of roofing tile segments mounted on the roof in horizontal rows forming alternating parallel pan channels and cap columns. The roof system comprises a roof vent having a vent skeleton, including one or more skeleton vent openings in ventilating communication with a roof opening. In addition, the vent skeleton has pan channels and cap columns. A solar panel is mounted to an upper, sun exposed surface of the roof vent.

In one arrangement, a roof system for a sloped roof is provided with a plurality of roofing tile segments mounted on the roof in horizontal rows, forming alternating, parallel pan channels and cap columns to channel rain and snow. In addition, one of the tile segments includes a vent skeleton having an upslope edge and a downslope edge, the vent skeleton being formed of a single continuous piece of material having an exposed pan section forming a segment of pan channel and a cap section. The vent skeleton includes one or more skeleton vent openings in ventilating communication with a vent opening through the roof, and the cap section forms a segment of a cap column. In addition, the pan and cap sections are overlapped by tile segments in an upslope row of tile segments, while the pan and cap sections are also overlapped by tile segments in a downslope row of tile segments. A fan unit is mounted to the skeleton in a position inline with the skeleton vent opening and the vent opening through the roof. A vent cap has an elongated axis parallel to the cap column and extends from a portion of the cap section, which is overlapped by the tile segments in the upslope row, to form a vent opening in ventilating communication with the skeleton vent opening. A solar array is mounted in a position to receive sunlight when the array is exposed to sunlight. The array is electrically connected to the fan unit to power the fan unit when the array is exposed to sufficient sunlight.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Preferred embodiments of the vents described herein preferably have two pieces, a primary vent and a secondary vent, and they may be made, without limitation, of such materials as aluminum, steel or copper. The primary vent is installed on a roof deck with a lower vent opening over a ventilation opening cut through the deck. The secondary vent, having a top surface to which the solar panel is preferably attached and an underside to which the fan is preferably attached, is constructed in the illustrated embodiments to otherwise look like the surrounding field tiles and is installed over the primary vent. The secondary vent has a skeleton with one or more vent openings through the cap areas. The caps are preferably spaced from the underlying cap areas of the skeleton and cover the upper vent opening (s), thereby creating a ventilating access between the cap areas and the caps. The one or more vent openings in the secondary vent and the opening in the primary vent conduct air between the attic or rafter space and the outside via the ventilating access.

Figure 1:
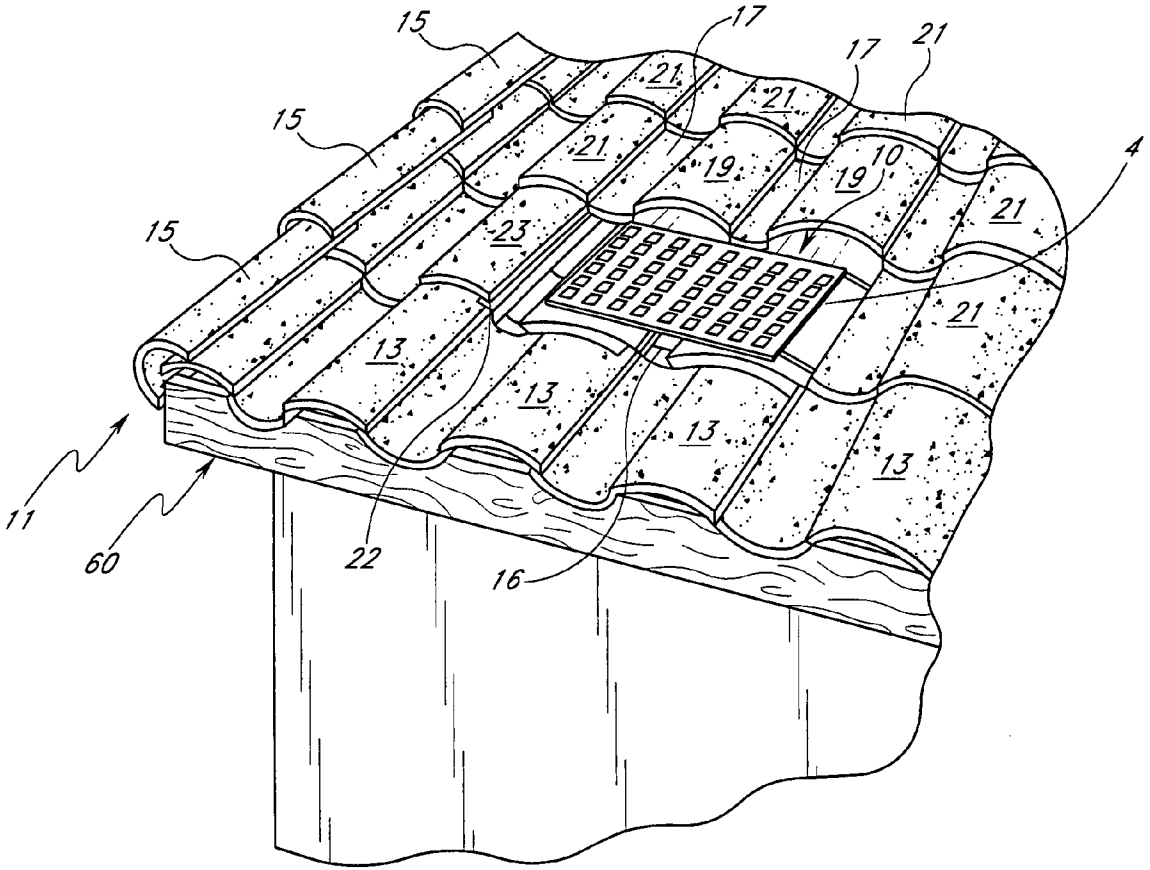
FIG. 1 is a perspective view of a secondary vent and solar panel, installed on a portion of a roof, in accordance with a preferred embodiment of the present invention.

Referring to FIG. 1, a section of pitched roof 11 near an eave 60 is shown. The roof includes a roof vent 10 having a solar panel 4 for powering an electrical device, such as a fan unit 8 (shown in FIG. 3B), according to a preferred embodiment of the present invention. The roof vent 10 includes caps 14 covering and overlying the cap areas 20 (FIGS. 3A–3B and 5) of a vent skeleton 16. The pitched roof 11 is generally composed of a plurality of field tiles 21, surrounded by edge tiles 13, edge caps 15 and ridge caps (not shown). As will be appreciated from FIG. 2B, the roof vent 10 is in two parts, a primary vent 40 and a secondary vent 12, to which the solar panel 4 is preferably mounted. The roof vent 10 may be formed from any suitable metal such as aluminum, steel, or copper. In a particularly preferred embodiment, the roof vent 10 is formed of 26 gauge galvanized steel.

Figure 2A:
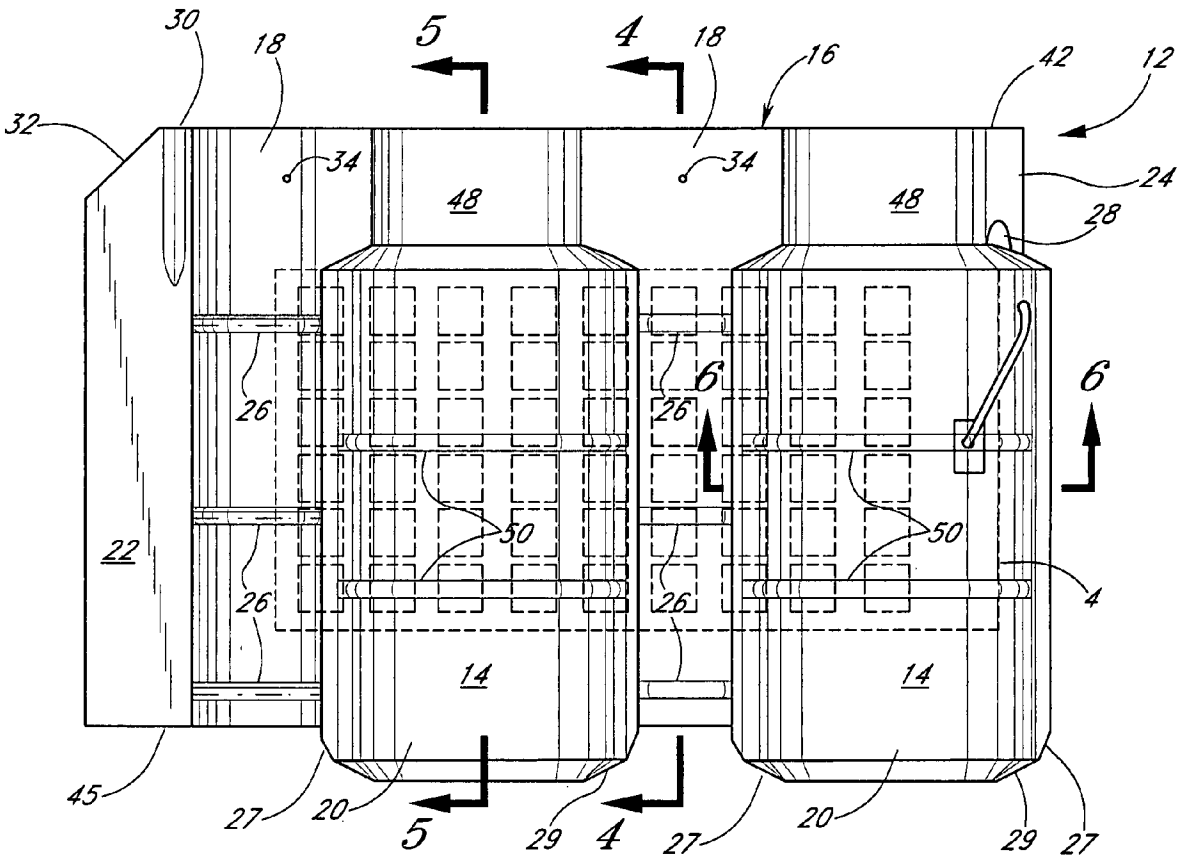
FIG. 2A is a top view of the secondary vent and solar panel shown in FIG. 1, the solar panel being shown transparent in order to illustrate features that would otherwise be covered by the solar panel.

Referring now to FIG. 2A, the secondary vent 12 includes one or more caps 14 spaced from the underlying cap area 20 of the vent skeleton 16 and preferably covering the underlying upper vent opening 36 (FIG. 6) in the skeleton 16. Preferably, a discrete cap 14 covers each cap area 20 which has an underlying upper vent opening 36 therein, leaving pan areas 18 exposed, i.e., not covered by caps 14. In the embodiment shown in FIG. 2A, one cap 14 covers an underlying cap area with the upper vent opening 36, while another cap 14 covers a cap area lacking the upper vent opening 36. In an alternate embodiment having a single upper vent opening 36, only one cap 14 is attached to the roof vent 10. In another embodiment in which multiple cap areas 20, each with an upper vent opening 36, multiple, discrete caps 14 are attached to the roof vent 10 to cover the multiple upper vent openings 36.

With further reference still to FIG. 2A, a cap flange 22 is configured to fit underneath the cap of an adjacent field tile, such as cap 23 (FIG. 1). The cap flange 22 may include one or more creases, such as the illustrated crease 30, to obtain a precise fit to an adjacent field tile. The cap flange 22 may also have one or more bevels 32 to minimize interference with an adjacent field tile. A pan flange 24 is configured to mate with the pan of an adjacent field tile, such as pan 25 (FIG. 1). The pan flange 24 may include one or more creases 28 to obtain a precise fit to an adjacent field tile. A plurality of ribs 26, 26A and 26B (FIG. 5) are preferably stamped into the skeleton 16 for increased rigidity. The ribs 26 are preferably parallel to upslope edge 42. A hole 34 is preferably included in each pan area 18 to accept a conventional fastener, such as a nail or a screw, to secure the secondary vent 12 to the pitched roof 11 (FIG. 1).

The solar panel 4 is configured to be integrated with a sun exposed portion of the secondary vent 12, preferably by securing the panel 4 to two or more caps 14, as shown in FIG. 2A. The panel 4 can be secured to the secondary vent 12 using conventional fasteners, such as screws or bolts, adhesives, or other securing methods known to those skilled in the art.

Figure 2B:
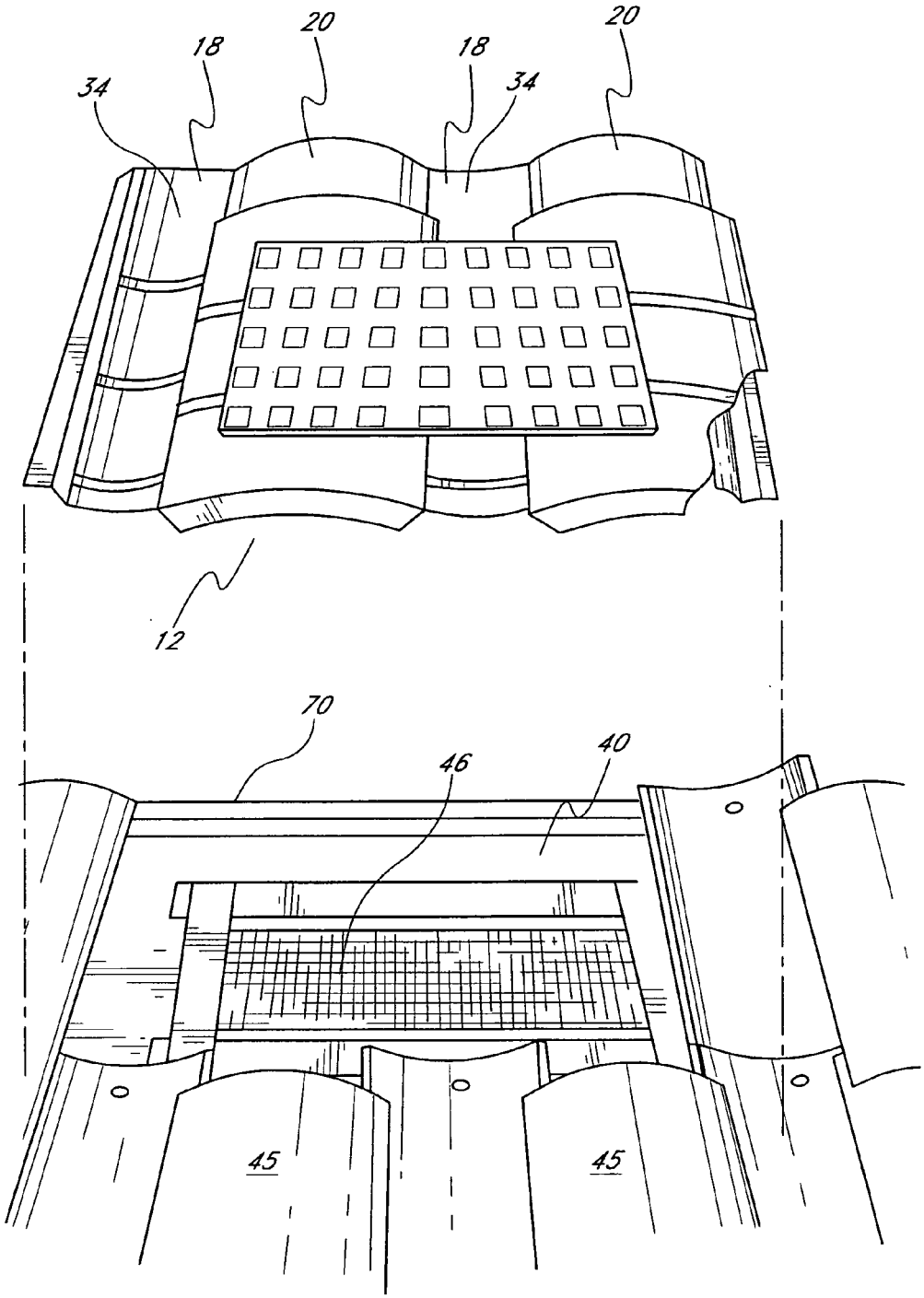
FIG. 2B is an exploded perspective of the secondary vent shown in FIG. 1, illustrating the relationship of the secondary vent with respect to an underlying primary vent and the surrounding roof tiles.

FIG. 2B is an exploded perspective showing the secondary vent 12 removed in order to illustrate the relationship between the underlying primary vent 40 and the surrounding roof tiles 45. The secondary vent 12 is shown properly oriented with respect to the underlying primary vent 40, which includes a lower vent opening 46, and the surrounding roof tiles 45 just prior to installation. As shown in FIG. 1 and 2B, the secondary vent 12 serves as a replacement for one or more of the field tiles 21 on the pitched roof 11. Different tile types and similar looking tiles from different manufacturers have different physical dimensions and may require a unique skeleton configuration for a precise fit between adjacent conventional tiles and the skeleton 16. The skeleton 16 may be made to fit the contours and edge configuration of the field tiles 21 used. The skeleton 16 may be formed in any conventional manner. The skeleton 16 is preferably stamped from a single piece of material to fit precisely the field tiles 21 for which it is intended to be used. The skeleton 16 preferably includes one or more pan areas 18 and a cap area 20 adjacent each pan area 18. Viewed from above, the pan areas 18 have concave upper surfaces and the cap areas 20 have convex upper surfaces. The pan areas 18 align with individual pan tiles or with corresponding pan areas of field tiles 21, such as pan areas 17 of FIG. 1. The cap areas 20 align with individual cap tiles or with corresponding cap areas of field tiles 21, such as cap areas 19 of FIG. 1. The secondary vent 12 is mounted with the pitch axis parallel to the pitch of the pitched roof 11 (FIG. 1).

Figure 3A:
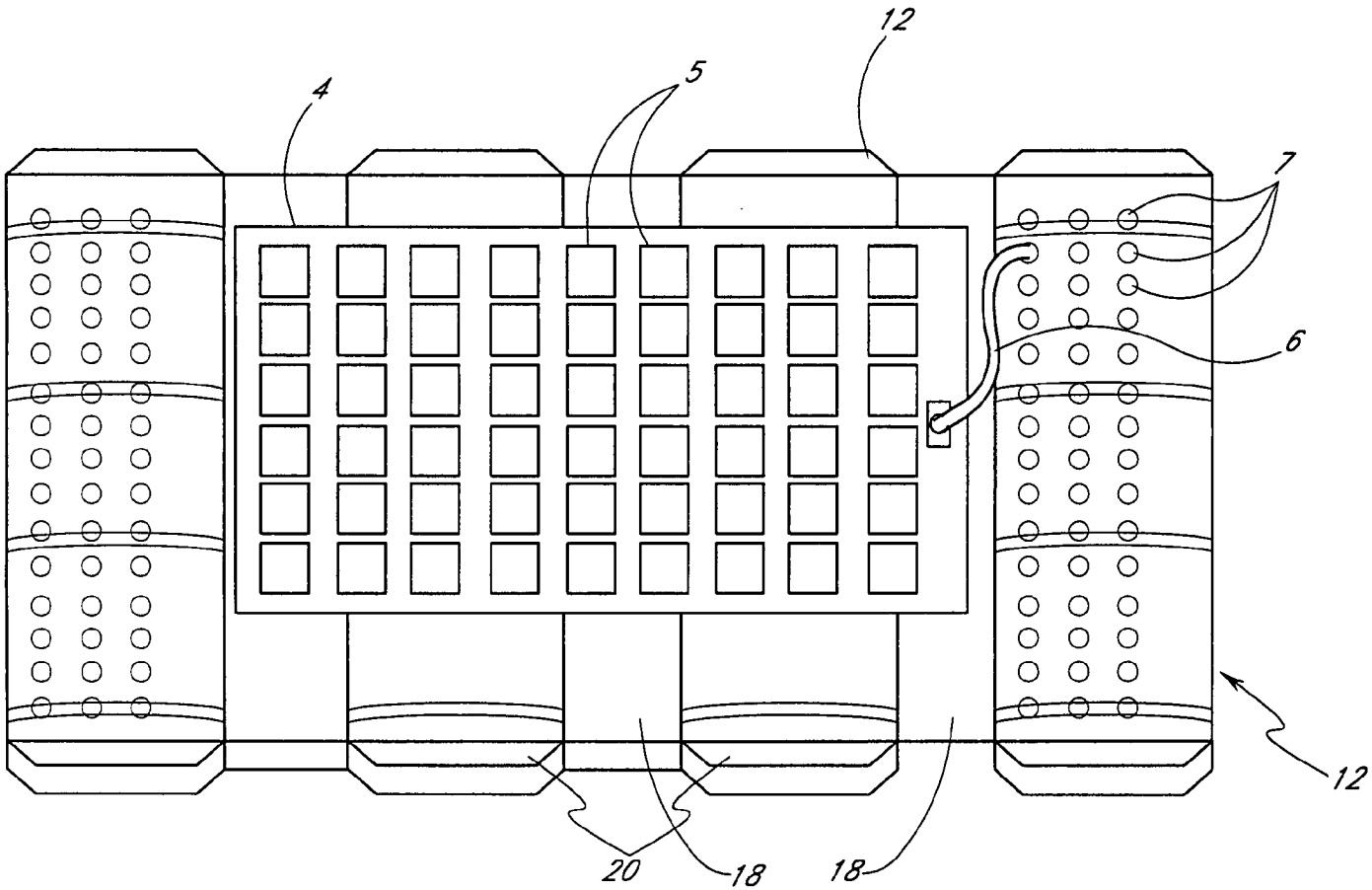
FIG. 3A is a top view of a secondary vent and a solar panel, in accordance with another embodiment of the present invention.

FIG. 3A is a top plan view of a preferred embodiment in accordance with an alternate arrangement. The solar panel 4 is attached to the secondary vent 12 with both the secondary vent 12 and the primary vent (not shown) being patterned to correspond with a different roof tile pattern than the pattern illustrated in FIG. 1. As shown, the solar panel 4 is preferably attached to the caps 14. In addition, the solar panel 4 is electrically connected to a fan unit 8 (FIG. 3B) by a conductive wire 6. In an alternate embodiment, the solar panel is attached to the portions of the skeleton upper surface not covered by the caps, e.g., pan areas 18 of the skeleton 16.

Figure 3B:
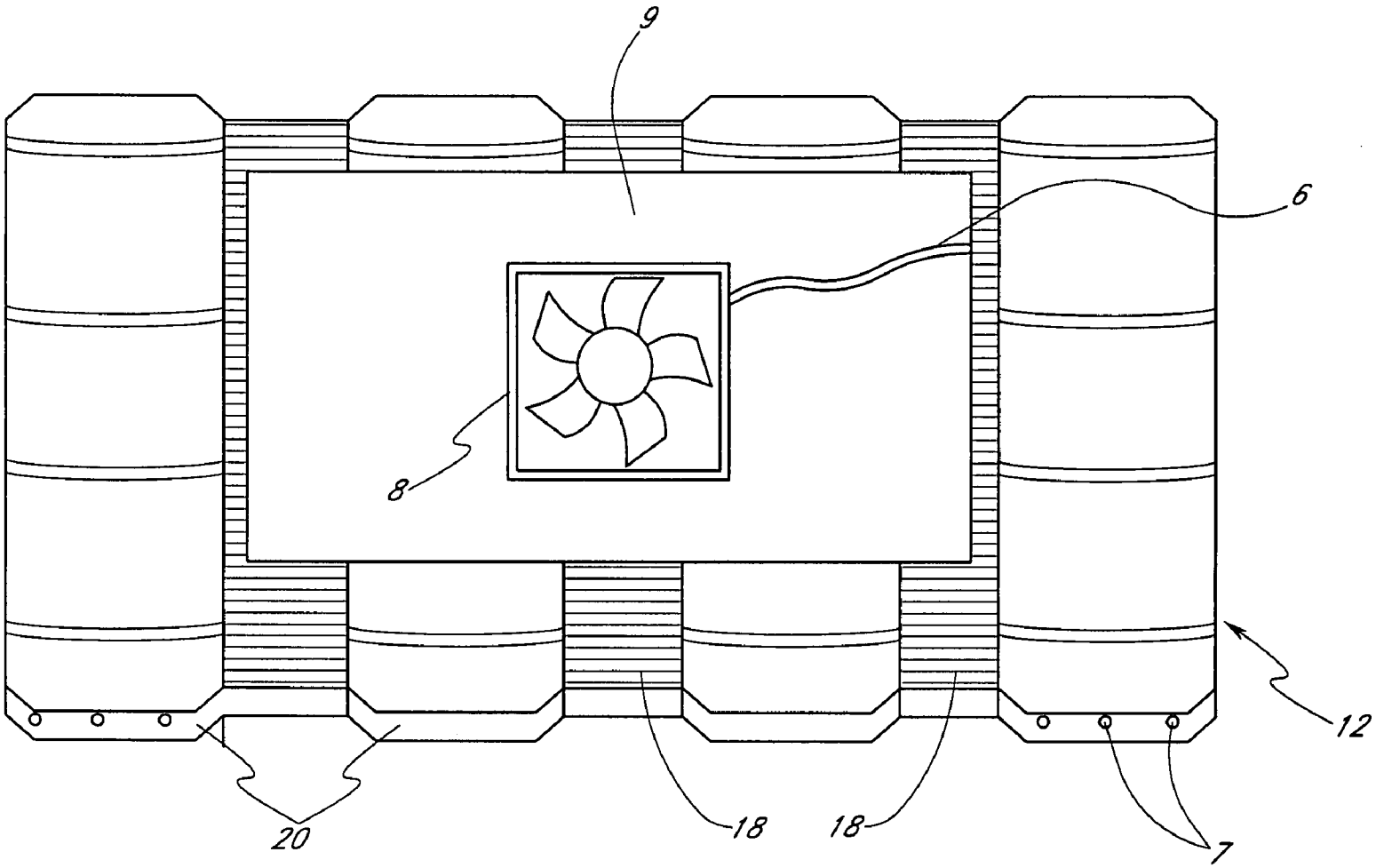
FIG. 3B is a bottom view of the secondary vent shown in FIG. 3A, the secondary vent skeleton including a fan unit.

FIG. 3B shows a bottom view of the secondary vent 12 having the fan unit 8 attached thereto. Preferably, the fan unit 8 comprises a fan blade driven by a motor, both contained within a fan housing which is attached to the underside of the vent 10 by a fan unit adaptor 9. In alternate embodiments, the solar panel can be configured to provide power to an electrical device other than a fan, such as a motor, light, battery, or any other electrical device for which it would be advantageous to provide electricity originating from the solar panel, as would be recognized by the skilled artisan.

FIGS. 3A–3B illustrate an embodiment in which the caps 14 extend laterally across the secondary vent 12 to cover the pan areas 18 of the skeleton 16, while in the embodiment shown in FIGS. 2A–2B a discrete cap 14 is employed to cover the underlying upper vent opening 36, leaving the pan areas 18 exposed, i.e., not covered by the caps 14. Preferably, if the caps 14 do substantially cover an upper surface of the skeleton 16, then cap holes 7 (or other openings) are included in the portion of the cap which does not directly overlie the upper vent openings 36, as shown in FIGS. 3A–3B. The cap holes 7 provide an exit or inlet for air traveling from or to the upper vent openings 36 via the ventilation access 54 (FIGS. 4 and 5) between the skeleton 16 and the caps 14.

Figure 4:
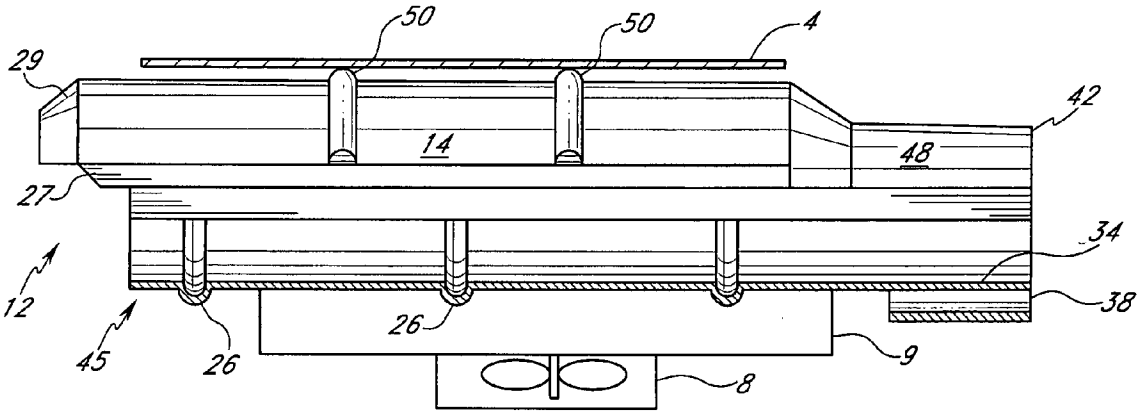
FIG. 4 is a cross-sectional view of the secondary vent and caps of FIG. 2A taken along lines 4—4.
Figure 5:
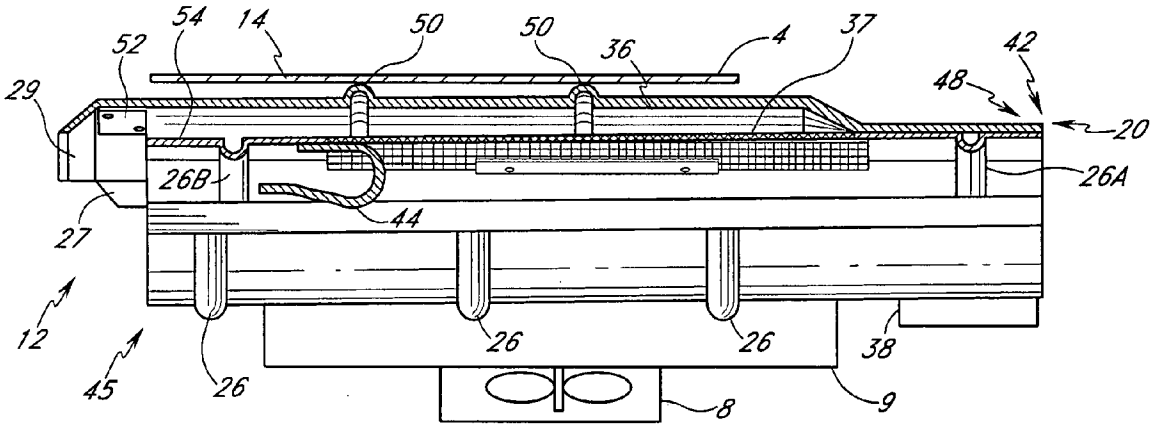
FIG. 5 is a cross-sectional view of the secondary vent and caps of FIG. 2A taken along lines 5—5.

Referring now to FIGS. 4 and 5, a profile of the embodiment shown in FIGS. 1 and 2A–2B illustrates a plurality of ribs 26, 26A, 26B, 50 and a turtle 38. Ribs 26 are shown concave up, although other configurations may be suitable. Rib 26B is shown convex up, although other configurations may be suitable. Rib 26A is preferably oriented concave up to minimize interference with the caps 14 at shoulder 48. Ribs 50 are shown concave down, although other configurations may be suitable. A plurality of legs 52 are attached to the skeleton 16 and to the caps 14 to support the caps 14 and to maintain a ventilating access 54 between the skeleton 16 and the caps 14. The legs 52 may be attached in any conventional manner.

The caps 14 shield upper vent openings 36 (in the secondary vent 12) from the weather and are attached to the cap area 20 of the skeleton 16 by any conventional means. The caps 14 are preferably spot welded at the shoulder 48 and the legs 52. The caps 14 include side hems 27, a front hem 29, and ribs 50. The ribs 50 preferably extend from one side hem 27 to the other (not visible) parallel to the front hem 29. The side hems 27 and the front hem 29 are included to improve the weather shielding efficiency of the caps 14 without sacrificing ventilating efficiency. Ribs 50 are stamped into the caps 14 for rigidity. The front and side hems 29 and 27 may be made in any conventional manner such as cutting and bending. Preferably, the front and side hems 29 and 27 are formed by stamping to increase the rigidity of the caps 14, and the caps 14 are made in one standard size. A standard size cap 14 may be fitted to many different skeletons thus minimizing manufacturing and inventory complexity.

Figure 6:
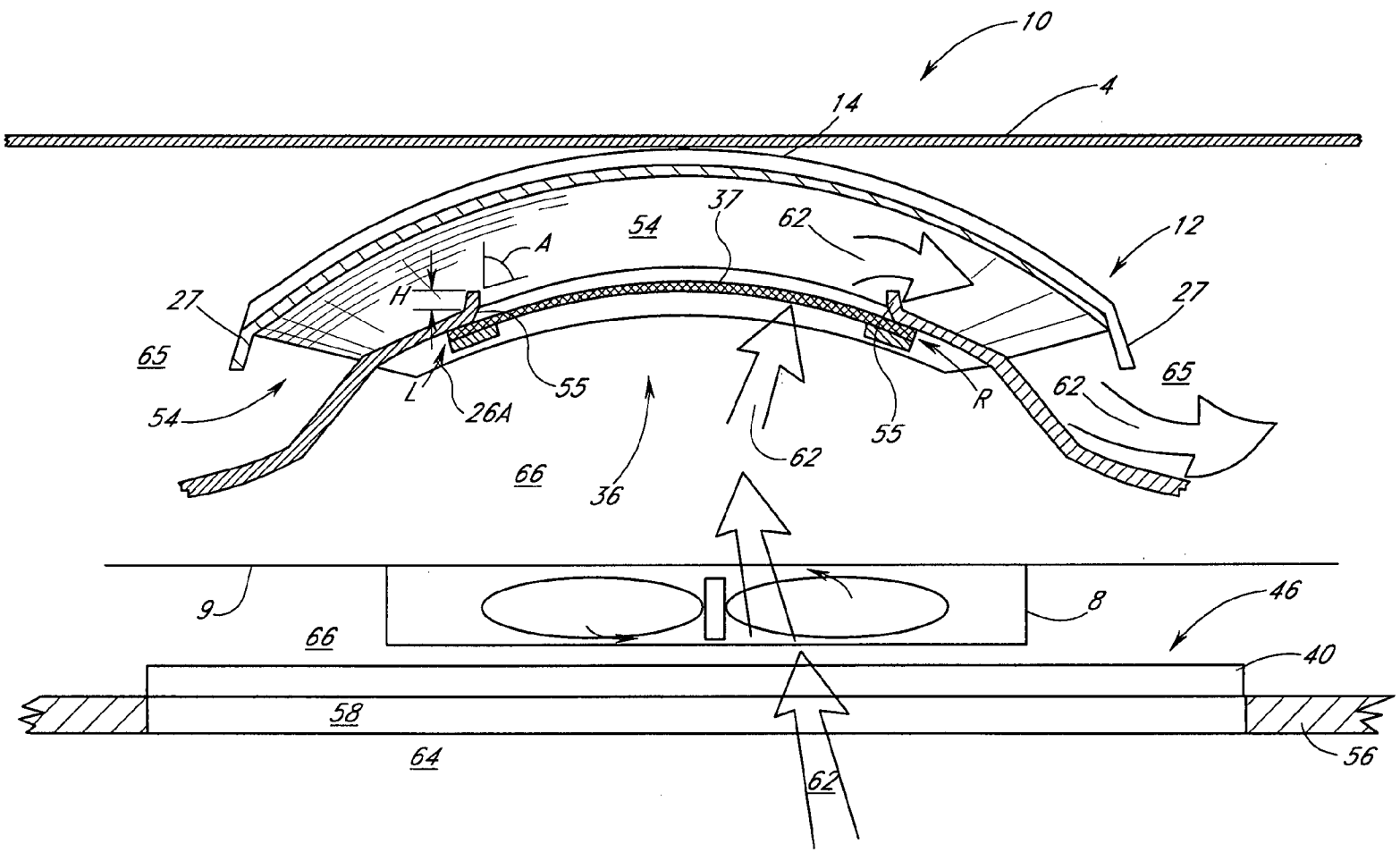
FIG. 6 is a cross-sectional view of the secondary vent and caps of FIG. 2A taken along lines 6—6.

Referring now to FIG. 6, the uniform relationship between the cap 14 of the secondary vent 12, the fan unit 8, and the primary vent 40 is shown. The vent 10 serves dual purposes, ventilating an attic 64 and protecting the attic 64 from weather and pests. The upper vent opening 36, the lower vent opening 46 and an attic opening 58 cooperate to conduct air 62 from the attic 64. The caps 14 are attached to the skeleton 16 as shields over the upper vent opening 36 to prevent weather and pests from falling directly into the attic 64. The caps 14 also prevent direct solar irradiation of the attic 64. The upper vent openings 36 are preferably covered by a screen 37 to prevent entry into a space 66 between the primary vent 40 and the secondary vent 12 by pests larger than the screen openings. Baffles 55 preferably shield the upper vent openings 36 from wind driven moisture and particles, and extend along edges R and L. Baffles 55 are H high and they are preferably folded up from a portion of the skeleton 16 surrounding or proximate to the upper vent opening 36 along angle A between 0° and 90° relative to the upper vent opening 36. Preferably, H is from 0.1" to 1.0" and angle A is from 20° to 80°. More preferably, H is from 0.2" to 0.6" and angle A is from 40° to 60°. Most preferably, H is about 0.25" and angle A is about 50°. As noted with respect to FIGS. 3 and 4, cap 14 includes side hems 27, and a front hem (not shown) to further shield the upper vent opening 36 from entry of foreign matter. The side hems 27 and the front hem preferably extend from the cap 14 to below the upper vent opening 36.

Air flow is indicated by reference numeral 62, showing an outward flow. It will be understood though, that the flow can follow the same path when the direction of flow changes, e.g., the path is substantially the same whether air flows from outside 65 into the attic 64 or air flows from within the attic 64 to the outside 65. For the sake of simplicity, attic air 62 flow from attic 64 to the outside 65 will now be described with the understanding that the embodiments described herein function equally well conducting air in either direction, i.e., in alternate embodiments the fan can be configured to blow air into the attic.

Air traveling through vent 10 preferably undergoes a change of direction that helps to prevent foreign matter from entering the attic 64. As installed, the lower vent opening 46 of the primary vent 40 provides a ventilating channel through the roof deck 56 for air flow convection and/or aided by the fan unit 8. The primary vent 40 conducts air up from within attic 64 through the attic opening 58 and lower vent opening 46 to the inter-vent space 66. Convection aided by the fan unit 8 or generated by the fan unit 8 alone continues to drive air 62 up through the upper vent opening 36 into the ventilating access 54. The air 62 in the ventilating access 54 is then conducted up over the baffles 55. Once above the baffles 55, the shape of the vent cap 14 and the side and front hems 27 and 29 cause the air 62 to change direction and travel out and down beyond the side hems 27 or the front hem 29 to the outside 65. The solar-powered fan 8, in addition to providing active ventilation alone, is employed in preferred embodiments in conjunction with the passive ventilation features of the present invention. If the relative temperature inside and outside of the attic is not enough to drive air by convection or if convection is ventilating the attic in a direction opposite the desired direction of ventilation, then ventilation can be driven by the fan unit 8.

Additional disclosure relating to the passive ventilation features and the installation of the ventilation system can be found in U.S. Pat. No. 6,050,039 to O'Hagin, the disclosure of which is hereby incorporated herein by reference for these purposes.

Advantageously, the preferred embodiments of the present invention provide a solar-powered ventilation system for an attic or rafter space that mimics the appearance of roofing tiles and protrudes minimally from the surface of the roof, thus having a minimal negative effect on the appearance of the building. In addition, the preferred embodiments advantageously provide a solar-powered fan, which preferably increases ventilation beyond that made possible by passive ventilation only. Since this fan is powered by a solar panel, the cost of operation is greatly reduced and the labor, wiring, etc. associated with connecting the fan to the house electrical grid is eliminated. Furthermore, because the solar powered vent preferably moves more air than an otherwise similar passive vent, fewer vents need to be installed, thus reducing installation costs and improving the aesthetic appearance of the roof. In alternate preferred embodiments, the integrated solar panel is electrically connected to an electrical device other than a fan, the electrical device being capable of being powered by the solar panel.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. A roof vent, comprising:

a primary vent configured to be provided over an opening in a roof, the primary vent including a screened opening for airflow through the vent;

a vent skeleton spaced above the primary vent, the vent skeleton having at least one skeleton vent opening there through for ventilating through the roof opening a volume of air underneath the roof;

a solar array integrated with the roof vent in a position capable of receiving sunlight when the roof vent is installed on a roof, wherein the vent skeleton is configured to, when installed on a roof, substantially mimic surrounding roofing tiles; and a fan positioned above the screened opening of the primary vent and below the vent skeleton and the solar array, the fan being electrically connected to the solar array.

2. The roof vent of claim 1, further comprising a cap substantially covering the skeleton vent opening.

3. The roof vent of claim 1, wherein the fan is mounted adjacent to both the skeleton vent opening and the screened opening in a position which allows the fan to facilitate the exchange of a volume of air located exterior to the skeleton vent opening and a volume of air located underneath the roof, the solar array being configured to power the fan.

4. A roof system for a sloped roof of the type in which a plurality of roofing tile segments mounted on the roof in horizontal rows forming alternating parallel pan channels and cap columns, the system comprising a roof vent comprising:

a primary vent provided over an opening in the roof, the primary vent including a screened opening for airflow through the vent;

a vent skeleton spaced above the primary vent, the vent skeleton including at least one skeleton vent opening in ventilating communication with the roof opening, the vent skeleton having pan channels and cap areas;

a solar panel mounted to an upper, sun exposed surface of the roof vent; and a fan positioned above the screened opening of the primary vent and below the vent skeleton and the solar panel, the fan being electrically connected to the solar panel.

5. The roof system of claim 4, wherein the fan is mounted adjacent to both the skeleton vent opening and the screened opening in a position which allows the fan to facilitate the exchange of a volume of air located exterior to the skeleton vent opening and a volume of air located inside a space partially defined by the roof interior, the fan being electrically powered by the solar panel.

6. The roof system of claim 5, wherein the fan is configured to force air from inside the space partially defined by the roof to an external environment.

7. A roof system for a sloped roof, comprising:

a plurality of roofing tile segments mounted on the roof in horizontal rows forming alternating parallel pan channels and cap columns to channel rain and snow; wherein one of the tile segments comprises, a vent skeleton having an upslope edge and a downslope edge, the vent skeleton being formed of a single continuous piece of material having an exposed pan section forming a segment of pan channel and a cap section, including at least one skeleton vent opening in ventilating communication with a roof opening, the cap section forming a segment of a cap column, the pan and cap sections being overlapped by tile segments in an upslope row of tile segments and overlapping tile segments in a downslope row of tile segments, a fan unit mounted to the vent skeleton in a position inline with the skeleton vent opening and the vent opening through the roof, a vent cap having an elongated axis parallel to the cap column and extending from the portion of the cap section overlapped by tile segments in the upslope row to form a vent opening in ventilating communication with the skeleton vent opening, and a solar array mounted in a position to receive sunlight, the array being electrically connected to the fan unit so as to power the fan unit.

8. The roof system of claim 7, wherein the fan unit comprises:

a fan adapter mounted to underlie the at least one skeleton vent opening, the adapter, combined with the underside of the vent skeleton, defining an adapter interior volume, the adapter being configured to have a fan hole through which substantially all of the ventilating communication between the skeleton opening and the roof opening travels; and a fan mounted to the adapter fan hole.

9. The roof system claimed in claim 7, wherein the vent skeleton and the vent cap are mounted together in the shape of the surrounding roof tiles.

10. The roof system claimed in claim 7, wherein the vent skeleton further comprises:

a cap flange to precisely fit under and against a cap of an adjacent field tile; and a pan flange to precisely fit against a pan of an adjacent field tile, wherein the upslope and downslope edges of the vent skeleton precisely fit against adjacent upslope and downslope field tiles respectively.

* * * * *